United States Patent [19]

Rowekamp

[11] 3,948,018

[45] Apr. 6, 1976

[54] DUAL CONVEYOR CASE PACKER

[75] Inventor: Edward F. Rowekamp, Cincinnati, Ohio

[73] Assignee: The Lodge & Shipley Company, Cincinnati, Ohio

[22] Filed: Aug. 30, 1974

[21] Appl. No.: 502,039

[52] U.S. Cl. ..... 53/61; 53/166; 53/202; 53/247; 53/251

[51] Int. Cl.[2] ..... B65B 57/14; B65B 5/06

[58] Field of Search ..... 53/61, 147, 154, 159, 166, 53/202, 247, 251, 164; 198/31 AA, 183, 34

[56] References Cited

UNITED STATES PATENTS

| | | | |
|---|---|---|---|
| 2,819,576 | 1/1958 | Hendricks et al. | 53/166 |
| 2,953,234 | 9/1960 | Abendschein | 198/183 X |
| 3,209,923 | 10/1965 | Bargel et al. | 53/247 X |
| 3,225,891 | 12/1965 | Hickin et al. | 53/164 X |
| 3,286,814 | 11/1966 | Atkinson | 53/61 X |
| 3,453,802 | 7/1969 | Riddington | 53/247 X |
| 3,486,292 | 12/1969 | Ninneman | 53/61 |
| 3,555,770 | 1/1971 | Rowekamp | 53/61 |
| 3,555,773 | 1/1971 | Rowekamp | 53/251 X |
| 3,601,951 | 8/1971 | Bargel et al. | 53/247 X |
| 3,770,096 | 11/1973 | Stohlquist | 198/183 X |

*Primary Examiner*—Travis S. McGehee
*Assistant Examiner*—Horace M. Culver
*Attorney, Agent, or Firm*—Wood, Herron & Evans

[57] ABSTRACT

Apparatus for packing bottles in cases wherein bottles are marshalled in two parallel lines with a case conveyor between the bottle lines. A bottle transfer mechanism straddles the bottle lines and case conveyor, the transfer mechanism having at least one, and preferably more than one, bottle lifting head for each bottle line. The transfer mechanism operates the lifting heads in tandem so that while one head is lowering bottles into a case, the other head is lowering to grasp bottles on a conveyor line. The lifting heads alternate in picking up bottles from the conveyor line and depositing them in cases.

The apparatus includes a roller chain conveyor mechanism to provide assurance of gentle handling of the bottles. The apparatus also includes a mechanism for forming plural lanes of bottles from a single file supply of bottles.

15 Claims, 9 Drawing Figures

DUAL CONVEYOR CASE PACKER

This invention relates to a case packer, and more particularly, the invention is directed to apparatus for packing bottles from two bottle conveying lines into cases on a single conveyor. While the invention will be described in connection with apparatus for packing bottles into cases, it should be understood that it is adapted for the packing of any articles which can be marshalled into a pattern lifted and deposited into cases.

There are two principal types of apparatus for packing cases which are being marketed today. The first, called a case packer, is of the type wherein a bottle conveyor and a case conveyor are run parallel with the bottles being stopped at a marshalling station and the cases being stopped adjacent the bottle marshalling station. A plurality of lifting heads mounted on a transfer mechanism are lowered onto the bottles, grip them in patterns corresponding to the pattern of cells in the cases, transfer them over to the cases and deposit them gently into the cases. After the deposit of bottles into the cases is made, the bottle conveyor is started to bring in a new supply of bottles and the case conveyor is started to bring in a new supply of cases. Thereupon the cycle of operations is repeated.

While that case packer has enjoyed considerable success in the marketplace, it has some disadvantages which the present invention seeks to overcome. For efficient operation the bottles must be brought in very rapidly and in sufficient numbers to permit up to five lifting heads to effect the transfer of bottles. The rapid movement of the bottle conveyor coupled with the requirement of stopping and starting the cycle of operations not only tends to cause bottle damage but is particularly unsuitable for the handling of oblong bottles. The oblong bottles tend to "shingle" in response to the pressure of all of the upstream bottles on them as they are stopped at the marshalling station.

The other type of case packer is a drop packer wherein a single pattern of bottles is marshalled over a case conveyor. When a complete pattern is marshalled, the support for the bottles is withdrawn to permit the bottles to drop into the cases. The drop packer has the disadvantage of permitting the packing of only one case at a time as well as the disadvantage of dropping bottles, particularly fragile bottles. Additionally, in the drop packer the bottles must be forced by the upstream bottles over a dead plate and grid support, for that is the mechanism by which the support for the bottles is removed to permit the bottles to drop into the case. As indicated above, oblong bottles do not respond particularly well to upstream pressure and, hence, the forcing of oval bottles to slide over a substantial distance is undesirable.

It has been an objective of the invention to provide an improved case packer wherein the bottles are handled more gently and wherein the marshalling speed for the bottles is greatly reduced without sacrifice of the case per minute packing speed of the apparatus. To this end the invention contemplates the use of two parallel conveyor lines for bottles and a single conveyor line for cases. A transfer mechanism straddles the conveyors and provides a set of lifting heads for each bottle conveyor line. The lifting heads operate alternatively and in tandem so that while one lifting head is moving down on bottles to grasp them, the other lifting head, carrying a set of previously grasped bottles, is depositing the bottles into the cases. The organization of bottle and case conveyors and transfer mechanism thus described permits the bottles to be brought into the marshalling station at one-half the speed of the known case packer in view of the fact that two bottle conveyors are feeding a single line of cases.

The invention further provides, at the marshalling station, an improved case elevator for raising multiple cases into position for receipt of bottles, thereby decreasing the distance the transfer mechanism must travel in each cycle of operations The invention further incorporates, as a bottle conveyor, a conveyor consisting of a pair of chains which supports between them rotatably-mounted rollers which support the bottles. This roller chain conveyor permits a more gentle handling of the bottles than has been possible with the conventional conveyors. Several features of the conveyor contribute to the gentle handling of the bottles. First, the conveyor can be maintained continuously running as contrasted with the stop and start operation of the conventional conveyor. The continuous running is permitted by the fact that the bottles, stopped at the marshalling station, are supported on anti-friction surfaces, that is, the rotating rollers. Thus, the only pressure of the bottles upon one another by the continuously moving conveyor arises out of the small amount of friction created by the rollers. Further, a gentle braking action is applied to the incoming bottles as the marshalled bottles are raised out of the marshalling station by a braking bar applied to the upper surface of the rollers. The braking bar causes the upper surface of the rollers to rotate in the opposite direction to that of the movement of the conveyor itself and at the same speed as the conveyor itself so that the two components of motion cancel each other out, thereby gently maintaining the bottles at a stationary condition.

Another feature of the invention consists of providing for the independent operation of the lifting heads on each side of the apparatus. If one side becomes decommissioned because of bottle breakage, misalignment or the like, the other side can nevertheless continue in operation.

It has been another objective of the invention to provide an improved apparatus for forming multiple lanes of bottles from a single file of bottles, the improved apparatus being particularly suitable for the handling of oblong bottles. This portion of the invention includes a swinging guide pivoted at its upper end adjacent the single file bottles, the downstream end being positionable adjacent any of the multiple lanes so as to direct bottles into the lane at which the guide is positioned. At the downstream end of the guide is a wheel having lugs or pins which project into the path of the bottles so that the bottles move past the wheel in turnstile fashion. A counter and circuitry are associated with the wheel and are connected to a braking mechanism. The counter and circuitry effect the operation of the brake after a predetermined number of bottles have passed. The braked wheel holds back the incoming bottles and permits the guide to be shifted to a new lane.

The bottles are directed from the guide onto the chain and roller conveyor described above. At the upstream end of that conveyor, accelerator bars are preferably placed in engagement with the undersurface of the rollers for a short length of the conveyor. The accelerator bars cause the rollers to rotate in the direction of the movement of the chain, thereby imparting to the bottles a component of motion approximately twice that of the conveyor so as to quickly draw the bottles away from the dead plate between the conveyor under the lane-forming apparatus and the roller and chain conveyor.

The several features and objectives of the invention will become more readily apparent from the following detailed description taken in conjunction with the accompanying drawings in which.

GENERAL ORGANIZATION AND OPERATION

Figures 1, 2, 3, 4, 9:
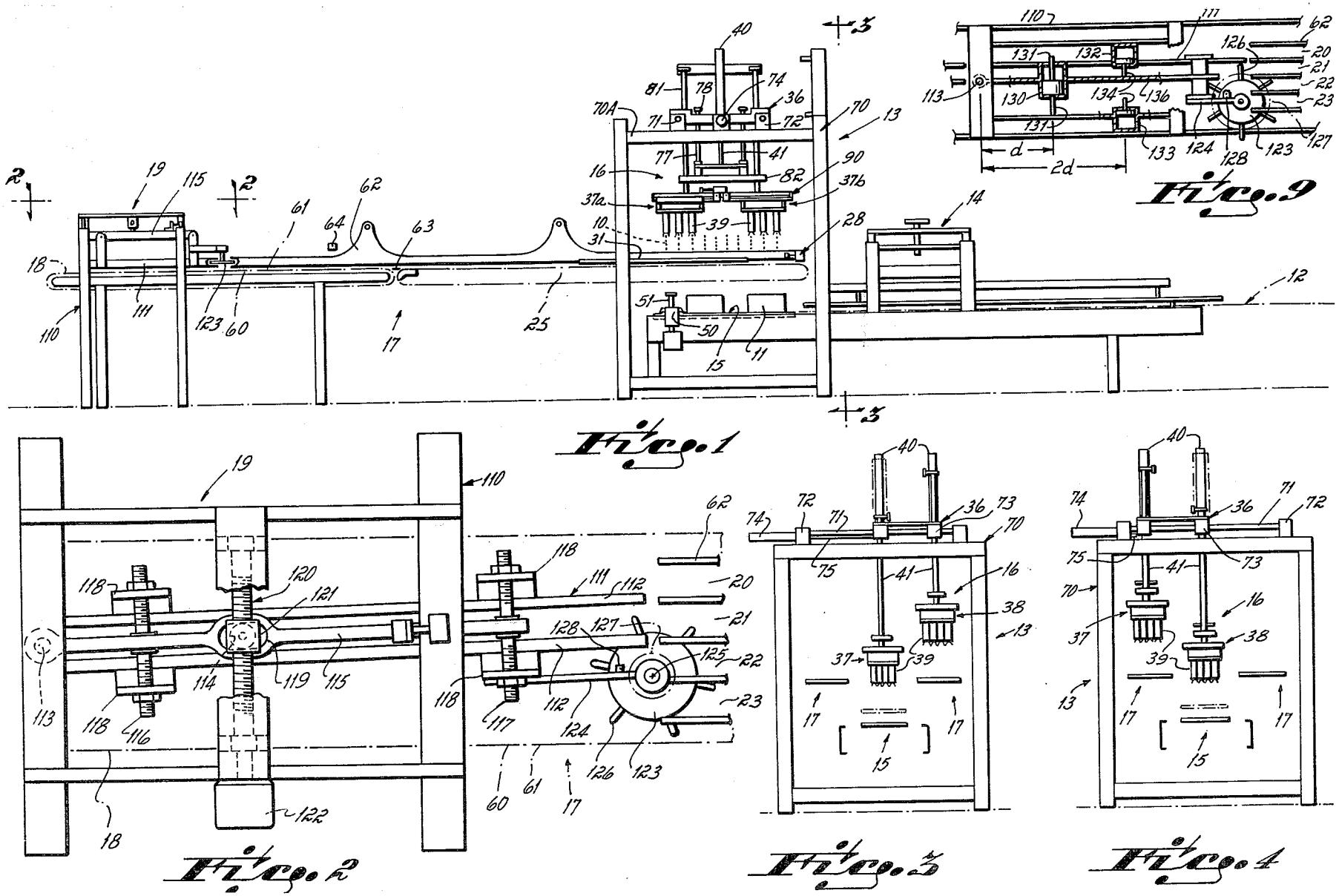
FIG. 1 is a diagrammatic side elevational view of the apparatus of the invention.
FIG. 2 is a top plan view of one embodiment of a row former, the figure being taken from lines 2—2 of FIG. 1.
FIG. 3 is a diagrammatic and elevational view of the loading station taken along lines 3—3 of FIG. 1.
FIG. 4 is a view similar to that of FIG. 3 showing the lifting heads in a different position.
FIG. 9 is a diagrammatic top plan view partly in section of an alternative embodiment of the row former of FIG. 2.

The apparatus of the present invention has as its primary objective to pack bottles 10 into cases 11. The cases are fed single file in spaced apart relation on a case conveyor 12 toward a loading or packing station 13 where two cases are stopped in position to receive, simultaneously, a pattern of bottles. The case conveyor carries the cases through a flap opener 14, ahead of the packing station, which opens up the flaps of the case and exposes the pattern of cells for receipt of the bottles. In the illustrated form of the invention, each case is adapted to hold twelve oval-shaped bottles, the bottles being arranged in a pattern of three rows, each row having four bottles. At the packing station 13 is a case elevator 15 which is adapted to raise the two cases 11 upwardly a few inches to a position in which the cases are to receive the bottles from a transfer mechanism 16. The raising of the cases is desirable in order to shorten the downward stroke of the transfer mechanism during which the bottles are deposited into the cases.

As illustrated in FIGS. 1, 3 and 4, the bottles 10 are conveyed on two conveyors 17 which move in the opposite direction from and parallel to the case conveyor, but it should be understood that the two conveyors could run in the same direction. The bottles are fed to each of the bottle conveyors from a pair of identical single file conveyors 18, each having a row former 19. The row former 19 shifts the bottles into four lanes 20, 21, 22 and 23. The bottles thus proceed to the loading station in the four lanes 20–23. Each bottle conveyor 17 has a downstream section 25 which consists of two endless chains 26 supporting a plurality of transverse rollers 27 (FIG. 6) rotatably mounted on the chains. At the loading station overlying the conveyor section 25 are stops 28, one stop being placed in each lane. Each stop has a pressure switch 29 which is set to detect the fact that a sufficient number of bottles have reached the loading station to form the required number of patterns to be transferred into the cases. Each stop 28 is also mounted for longitudinal movement and is connected to a piston and cylinder 30 which pulls each stop out of the way when the pattern of bottles is lifted by the lifting heads. The downstream section 25 of the bottle conveyor also has an elongated brake 31 which is engageable with the upper surfaces of the rollers 27 in order to brake movement of the bottles into the loading station during a transfer operation.

When a sufficient number of bottles have been marshalled in the loading section 13, the bottles are transferred by the transfer mechanism 16 from the bottle conveyor to the cases supported on the case elevator 15. The transfer mechanism includes a horizontally movable carriage 36 which supports two sets of lifting heads 37 and 38 (FIG. 3). Each set 37 or 38 may have one or more lifting heads. In the illustrated form of the invention, two lifting heads **37*a* and 37*b* are shown in set 37 and two lifting heads 38*a* and 38*b* are shown in set 38. Each lifting head carries a pattern of 12 bottle grippers 39 corresponding to the pattern of cells in the cases 11.** The grippers may be of any suitable type, preferably pneumatically operated, the particular type of gripper being dependent upon the style of the bottle to be transferred, see, for example, U.S. Pat. Nos. 2,873,996 and 3,108,835.

Each set of lifting heads is adapted to be raised and lowered independently of the other set by pistons and cylinders 40, each having a movable piston rod 41 connected to the respective set of heads.

In the operation of the invention, cases 11 are fed to the case elevator 15. When two cases, corresponding to one set of lifting heads, have arrived at the elevator, the elevator raises the cases to the broken line position illustrated in FIGS. 3 and 4.

Simultaneously, the bottles are continuously fed toward the loading station 13. First the bottles are a single file until they pass through the row former 19 which distributes the bottles into the four lanes 20–23 in equal numbers. The bottles continue to be conveyed toward the loading station until they engage the stops 28. When a sufficient number of bottles to make up patterns for loading the two cases has been brought into the loading station, as determined by the pressure of all of the bottles on the pressure switches 29, a first transfer operation begins. The first set of lifting heads, for example, 38 in FIG. 3, is lowered onto the bottles and the grippers grasp the necks of the individual bottles.

The piston rod 41 is then retracted, lifting the bottles upwardly away from the conveyor. Substantially simultaneously with the raising of the lifting head is the application of the brake 31 to the rollers. The effect of the application of the brake is to permit the rollers to continue to move but to cause them to rotate in such a direction that their upper surfaces which engage the bottles are effectively moving in the opposite direction from the movement of the conveyor chains so that the bottles do not advance during the removal of the bottles by the lifting heads.

When the bottles are raised a sufficient height, the carriage 36 moves transversely to carry the lifting heads to a position overlying the open cases 11. When in the proper transverse orientation, the piston rod 41 is extended to lower the bottles gently into the cases. As can be seen from FIG. 4, the transverse movement of the carriage 36 to align the lifting heads 38 with the cases also carries the lifting heads 37 to a position aligned with the bottles on the opposite bottle conveyor. As soon as a pattern of bottles is detected under the lifting heads 37, the lifting heads are lowered to engage the bottles and to grasp them and the brake 31 associated with that conveyor is applied. In the meantime, the lifting head 38, having deposited its bottles, is raised and the lifting heads 37 are raised to lift the bottles away from the conveyor. The carriage 36 then moves in the opposite direction to return to the position of FIG. 3. The lifting heads 37 are then aligned in position to deposit the bottles carried by the lifting heads into a new set of cases which has arrived from the case conveyor.

It can be seen that through the tandem operation of two sets of lifting heads, the supply of cases on a single case conveyor can be filled with bottles being marshalled on the two bottle conveyors with the movement of the bottles being approximately one-half the speed that would be required if only one set of lifting heads were employed as is common practice.

The Conveyor System

The conveyor system includes the case conveyors and the bottle conveyors. The case conveyor feeds cases 11 into the loading section 13 in spaced apart relation.

Figure 8:
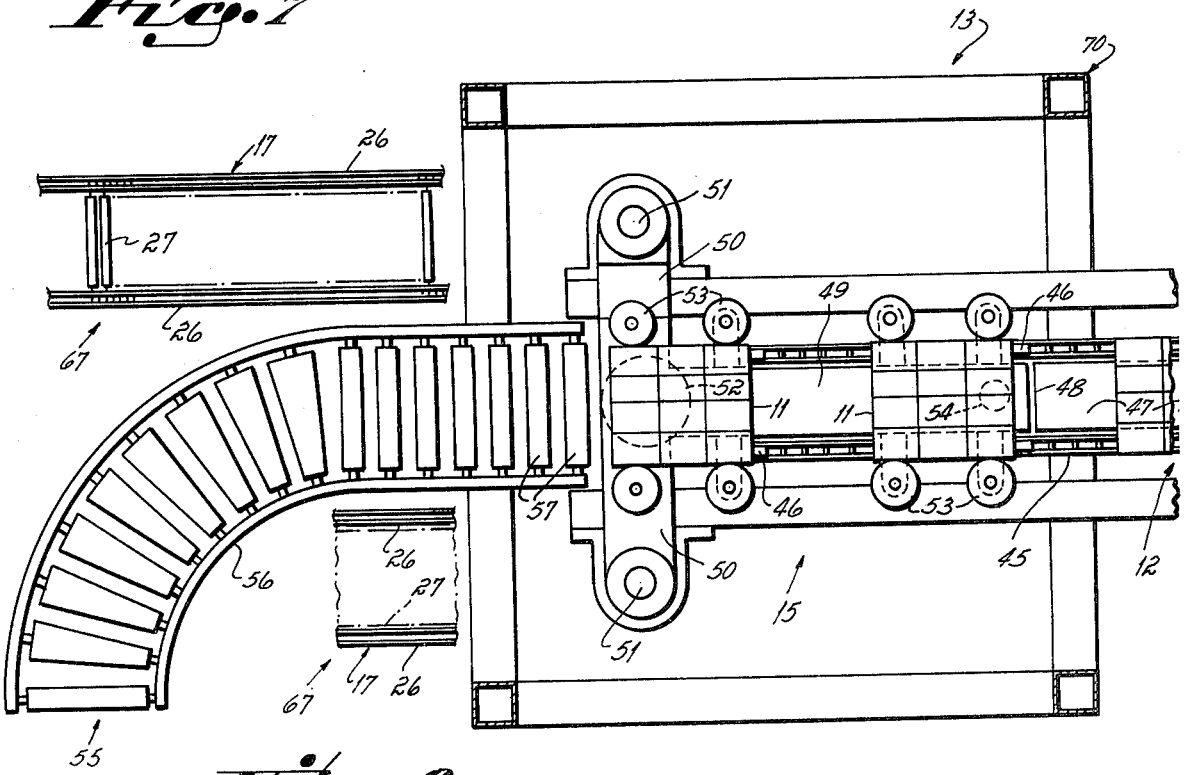
FIG. 8 is a top plan view partly in section of a case elevator and case conveyor mechanism at the marshalling station.

Referring to FIG. 8, the case conveyor has a pair of endless chains 45, each having longitudinally spaced lugs 46 which engage the trailing edges of the cases 11 to thrust them into the loading section 13. A support plate 47 is located between the two conveyor chains to provide support for the cases as they are conveyed into the loading section. The support plate 47 terminates at 48 in the loading section and is continued by a tongue 49 forming part of the case elevator 15. The tongue is cantilevered rearwardly from a frame 50 which is vertically slidable with respect to vertical posts 51 on each side of the case conveyor. An expandable bellows 52 of the type described in U.S. Pat. No. 3,307,328 is adapted to expand upon the introduction of air under pressure and raise the elevator 15 to a proper height for loading the cases. The tongue 49 cantilevered from the elevatable frame carries two sets of spaced apart flexible discs 53 which frictionally receive and hold the cases in a proper case loading position after the chains 45 have thrust them into the loading section.

A shock absorber 54 is fixedly located below the tongue 49 at its upstream end so as to damp the vibrations of the tongue when air is exhausted from the cushion 52 to lower the filled cases.

A discharge conveyor 55 extends longitudinally from the downstream end of the chain conveyor and is curved as at 56 to discharge cases transversely or at right angles to the direction of movement of the case conveyor. The discharge conveyor also is inclined downwardly to permit the filled cases to pass beneath the incoming bottle conveyor. The discharge conveyor includes a pair of spaced apart rails which support powered rollers 57 which pick up the cases as the chain conveyor drives them through the loading station after they have been loaded and conveys them out at right angles to the apparatus.

The flap opener 14 associated with the case conveyor is of no particular significance to the present invention, and, in fact, may not be required at all in operations wherein bottles are loaded into cases, such as half cases, which have no flaps.

A bottle conveyor 17 is located at each side of the case conveyor so as to provide two patterns of bottles at each side of the loading station. Each conveyor includes an upstream section 60 and a downstream section 25. The upstream section may be formed of a common flat tabletop-type chain 61 which receives bottles at its upstream end in single file relation. The upstream section is driven independently of the remainder of the apparatus by a variable spaced drive not shown. Overlying the conveyor sections 60 and 25 are five lane dividers or guides 62 which divide the conveyors into the four lanes 20–23. Overlying the upstream portion of conveyor section 60 is the row former 19 which receives the single file bottles and distributes them into the four lanes. At the downstream end of the section 60 the bottles cross a dead plate 63 and onto the downstream section 25. Electric eye detectors 64 are located at the downstream end of section 60 to detect a back-up of bottles going into the loading section. When detected, wheel 123 (to be described below) is stopped to prevent jamming of the row former 19.

Figures 5, 6:
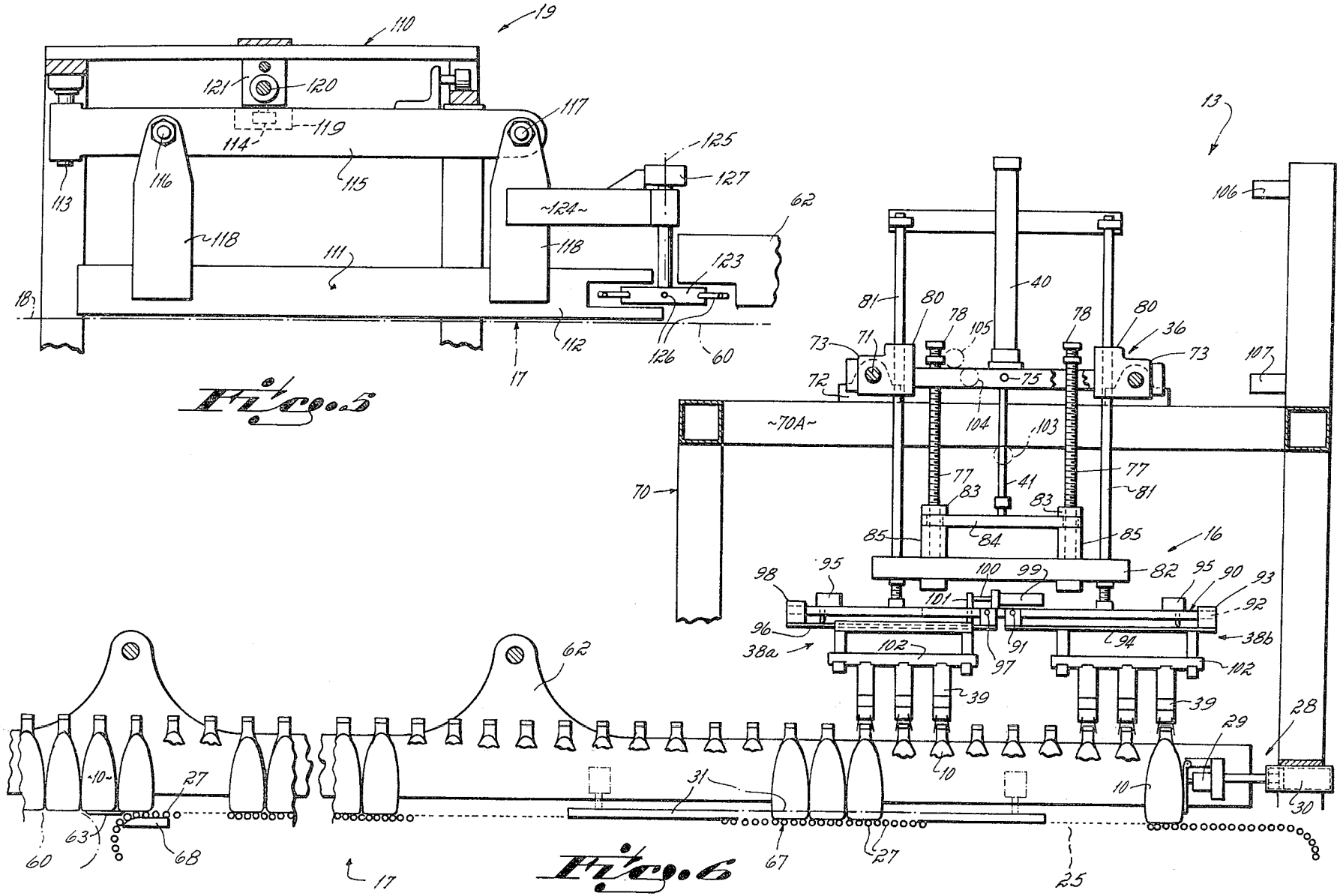
FIG. 5 is a side elevational view of the row former of FIG. 2.
FIG. 6 is a side elevational view, partly in section, of the marshalling station and the conveyor feeding into the marshalling station.
Figure 7:
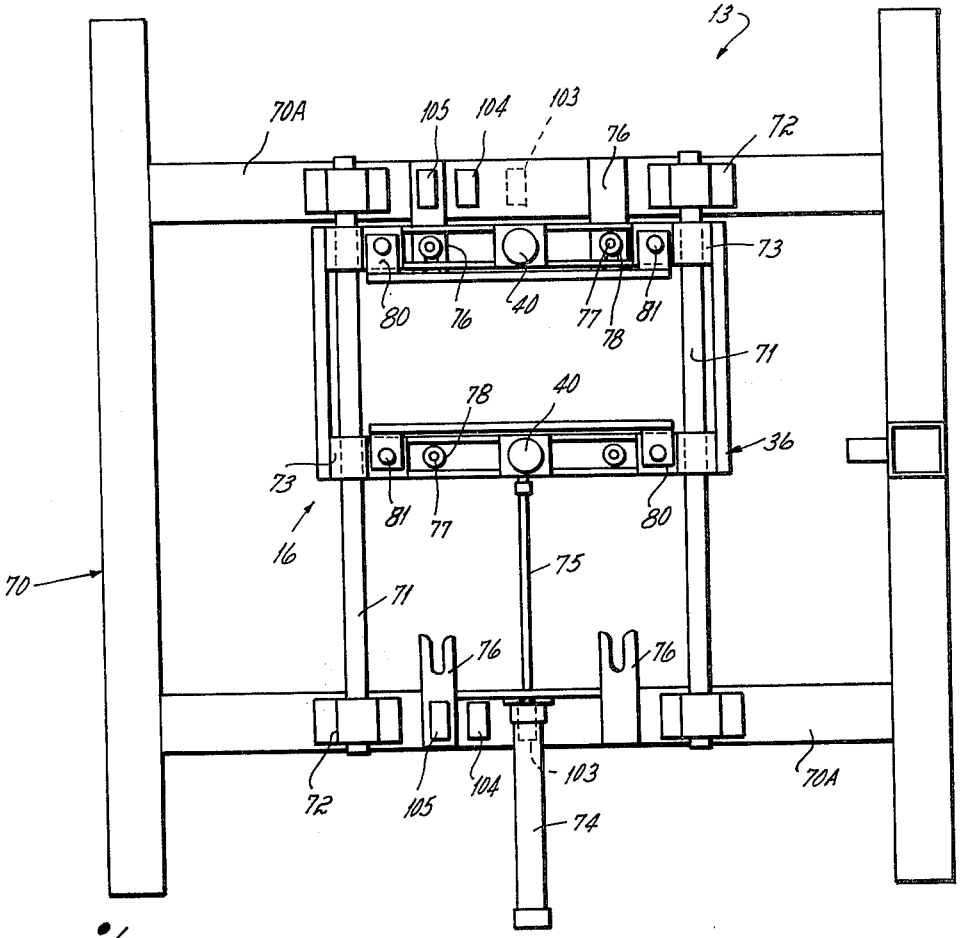
FIG. 7 is a top plan view of the marshalling station of FIG. 6.

As shown at 67 (FIG. 8), the downstream section is formed by a plurality of closely spaced rollers 27 freely rotatably-mounted between two endless chains 26 and supported on opposed pins projecting from the chains. The chains 26 are continuously moving throughout the operation of the apparatus. At the upstream end of the conveyor section 25 and located underneath the upper flight of the conveyor is a pair of short accelerator bars 68 (FIG. 6). The accelerator bars 68, in engagement with the underside of the conveying rollers 27, cause the rollers to rotate in a clockwise direction as viewed in FIGS. 1 and 6, thereby substantially doubling the conveying speed of the rollers on the bottles. The accelerator bars are used only over a short portion of the conveyor section 25 in order to bring the bottles quickly off the dead plate 63 and onto the conveyor section 25.

The brake bar 31 at the downstream end of the conveyor section 25 being applied to the upper surface of the rollers has the effect on the rollers opposite to that of the accelerator bar 68. In other words, the brake bar 31 causes the rollers which it engages to rotate in a counterclockwise direction so that their upper surfaces or the lines of the rollers which contact the bottles are moving in a direction opposite to that of the movement of the conveyor, thereby neutralizing the forward motion of the conveyor. The effect of the brake bar is to bring the bottles gently to a halt as well as gently starting the bottles in their forward movement when the brake bar is raised. When this is contrasted to the conventional starting and stopping of a conventional tabletop conveyor of the type indicated at 61, it will be understood that the possible damage to the bottles is greatly reduced.

As indicated above, the bottles are brought into the loading station 13 and the leading bottle in each lane moves against the pressure switch 29 of the stop 28. The pressure switch 29 is a switch which is held open by air pressure, the force of which can be varied. The pressure switch therefore can be very finely regulated to close when a preselected number of bottles, all in abutting relation, have arrived at the loading station.

The pressure on the bottles arises out of the forward thrust imparted to them by the conveyor section 25. This is a very gentle thrust in view of the fact that the rollers 27 are rotatably mounted and will rotate in a counterclockwise direction when there is any resistance to the continued movement of the bottles which they support. Therefore, the pressure of the bottles upon one another and upon the pressure switch 29 is derived substantially entirely from the frictional resistance to rotation of the rollers. Since the magnitude of the resistance is low, the bottles will be brought gently against the stop 28 and pressure switch 29. This again must be contrasted to a conventional conveyor system wherein the bottles are continually urged forward by the movement of the supporting conveyor on the underneath surface of the bottles until a sufficient number of bottles has been accumulated at the loading station.

As indicated in the general description, each stop is connected to a piston and cylinder which is connected into the control system to move the stops downstream just prior to the lifting of the bottles off the conveyor. Thus, any possibility of abrading the bottles or damaging the pressure switches is avoided.

Transfer Mechanism

The transfer mechanism 16 is supported on a rectangular shaped frame 70. It includes two parallel rods 71 mounted in blocks 72 on top of the frame 70. The rods support the carriage 36 which is mounted on the rods by means of bearing blocks 73. The carriage is connected to a centrally located double-acting piston and cylinder combination 74 having a horizontally-movable piston rod 75 connected to the carriage 36. The application of fluid pressure to one side or the other of the double-acting cylinder causes the piston rod to pull the carriage 36 to the left as viewed in FIG. 3, or thrust it to the right as viewed in FIG. 4. The frame is also provided with four stops 76, two at each side of the frame, which receive vertical screws 77 secured to the carriage 36 and having adjustable nuts 78 on their upper ends. The cooperation of the screws 77 and nuts 78 with the stops 76 serves to provide the proper stroke for the gripper mechanisms 39 to engage the bottles to be picked up.

The carriage 36 supports bearing blocks 80 which slidably receive two vertical rods 81 associated with each lifting head. The carriage 36 also supports the vertical double-acting piston and cylinder combination 40 having the vertically movable piston rod 41. If fluid pressure is introduced into the cylinder at one side or the other, the piston rod 41 is raised or lowered, carrying with it the set of lifting heads to which it is connected.

The lower ends of the vertical rods 81 are connected to a cross bar 82. The screws 77 are also secured to the cross bar 82 and are slidable with respect to a cross bar 84. Spacers 85 are sandwiched between the cross bars and secured by lock nuts 83 to accommodate bottles of various heights.

The cross bar 82 supports a frame 90. A fixed lifting head **38*b* is pivoted to the frame 90 on a pin 91. The opposite end 92 is free to swing in a vertical arc between very narrow limits as determined by a block 93 which is fixed to a lifting head plate 94 and loosely engages the frame 90. A micro switch 95 is secured to the frame 90 and is engageable by the lifting head plate 94. If the lifting head engages a misaligned bottle, it will cause the lifting head plate to pivot slightly upwardly about its pin 91, thereby closing the micro switch 95 to reverse direction of flow of fluid to the double-acting cylinder 40, thereby causing rod 41** to raise the lifting head.

The lifting head **38*a* is similarly constructed in that the lifting head is supported on a plate 96 which is pivoted on a pin 97 and freely movable about a vertical arc at its opposite end as determined by the loose fit of block 98 with the frame 90.**

A micro switch 95 is also located between the frame 90 and the plate 96 to interrupt the descent of the lifting heads in the event of detecting a jam or misaligned bottle. The lifting head **38*a* is, in contrast to the head 38*b*, slidably mounted on the plate 96. A double-acting piston-cylinder 99 is mounted on the frame 90 with a piston rod 100 being connected by a bracket 101 to the slidable head 38*a*. Thus, the introduction of fluid pressure to the cylinder 99 causes a movement to the left or right, as viewed in FIG. 6, on the lifting head 38*a* with respect to the lifting head 38*b*. This relative movement between the two lifting heads enables the lifting head 38*b* to engage the bottles adjacent the stop 28 and to deposit them in a case 11 while at the same time causing the lifting head 38*a* to engage a pattern of bottles at one longitudinal position of the lifting head and to deposit the bottles in a case 11** which is at a slightly different longitudinal position. This in turn permits the cases to be conveyed on standardized spacing or centers as determined by the conveyor chains available in the marketplace and to accommodate the two longitudinally spaced lifting heads to that bottle spacing determined by the dimensions of the bottles.

The lifting heads **37*a* and 37*b* are constructed and supported similarly to heads 38*a* and 38*b*** described above.

Each lifting head has a manifold 102 to which the individual grippers 39 are attached so that the application of fluid pressure, usually pneumatic, to the manifold 102 will cause the simultaneous operation of all grippers 39.

The transfer mechanism frame 70 supports proximity switches 103, 104, 105 on each side of frame 70A and proximity switches 106 and 107 at the center of frame 70. The proximity switches detect the vertical and horizontal approach of the heads and carriage and are connected into the control system to control motion of the apparatus without requiring direct contact, as is the case with micro switches. Switch 104 is mounted on the frame to cooperate with a portion of the carriage and thus detects the approach of the carriage and stops the transverse movement of the carriage in its position overlying bottles accumulated on the conveyor section 25. The switch 103 is mounted to the frame and cooperates with a portion of the carriage to indicate that the carriage is oriented at the proper vertical height above the bottles on the conveyor section 25. When the carriage reaches the limit of its transverse stroke and is positioned vertically, as determined by the control system associated with the switches 104 and 103, respectively, the lifting heads stop in a "ready position" prior to beginning a descent. As mentioned above, when the switches 29 of the four lanes have all been activated, the heads will be lowered; the extent of the descent is determined by switch 105. When detected, the control apparatus will stop the descent of the lifting heads in a "gripping" position. There, the gripping heads surround the bottle tops and upon application of pressure to the manifolds 102, the bottles will be gripped.

Proximity switches 106 and 107 mounted at the center of the frame control the movement of the lifting head for the packing operation. Switch 107 determines the extent of the downward movement of the lifting head to deposit the bottles in the cases. Switch 106 detects the arrival of the lifting heads at the full up position so as to permit the carriage to begin its transverse movement for the next cycle of operations.

Row Former

Two embodiments of the row former 19 are illustrated in FIGS. 2 and 9, respectively. In FIG. 2, the row former has a frame 110 which supports a swinging guide 111 formed by two longitudinally extending bars 112. The guide 111 is pivoted about a pin 113 at its upstream end, the pin 113 being mounted in the frame 110 at the transverse center of the upstream conveyor section 60 where the guide receives single file bottles. The guide 111 includes a longitudinally extending bar 115 which supports an upstream screw 116 and a downstream 117 whose threads on each side of the bar 115 are of opposite hand. The screws are threaded into brackets 118 which are in turn fixed to the bars 112, thus providing the support for the bars 112. The support is adjustable in that rotating the screws 116, 117 will cause the spreading or contracting of the spacing between the bars 112 to permit the bars to accommodate bottles of varying sizes. A control screw 120 is transversely and rotatably mounted in the frame 110. The screw is threaded into a block 121 which is both rotatably and slidably mounted on the frame 110. A roller 114 depends from the block 121 and is engageable with a slot 119 in the bar 115. It can be seen that the rotation of the screw 120 will cause the block 121 to move transversely with respect to the conveyor section 60 and, hence, through the roller 114 swing the bar 115 and the guide 111 which it carries about the pivot pin 113. The screw is connected to a stepping or pulse motor 122 which is in turn connected to a control circuit adapted to pulse the motor with a preselected number of pulses to rotate the screw through a predetermined number of revolutions so as to precisely position the free end of the guide 111 adjacent any respective lane 20–23.

A control wheel 123 is mounted on a bracket 124 fixed to one of the guide bar brackets 118 and adapted to rotate about a vertical axis 125. The wheel has pins or lugs 126 spaced uniformly about its periphery and projectable into the space between the guide bars 112. The wheel 123 is normally freely rotatable but has a brake 127 adapted to stop the rotation of the wheel with any selected pin 126 projecting into the path of the bottles as illustrated.

An electric eye 128 is mounted on supporting bracket 124 and reads indicia on the wheel to detect and count the passing bottles. Programmable counters and control circuitry are associated with the electric eye to count the bottles passing by the wheel 123, and after a preselected number of bottles have passed, to brake the wheel, thereby blocking further passage of bottles. When the bottles are braked, the operation of the stepping motor 122 is initiated to swing the guide 111 to the next adjacent lane. After the guide reaches the next adjacent lane, the stepping motor is deenergized and the brake on the wheel 123 released so that the conveyor section 60 can continue to drive bottles through the lane with which the guide is aligned. An exemplary form of the operation could be to guide six bottles to lane 20,, shift to lane 21, guide three bottles into lane 21, shift to lane 22, guide three bottles into lane 22, shift to lane 23, guide six bottles into lane 23, shift to lane 22, guide three bottles into lane 22, shift to lane 21, guide three bottles into lane 21, shift to lane 20, guide six bottles into lane 20, etc.

The embodiment of FIG. 9 is substantially identical to that of FIG. 2 except for the mechanism by which the guide is swung about its pivot axis 113. In FIG. 9, the guide 111 carries a double-acting pneumatic cylinder 130 located at a distance *d* from its pivot axis 113. A piston rod 131 is connected to the frame 110 so that introduction of fluid pressure into either end of the cylinder will cause the guide to swing between the middle two lanes, that is, lanes 21 and 22. Two opposed cylinders 132, 133 of diameter equal to the diameter of the cylinder 130 are mounted on the frame. Each has a projecting piston rod 134 engageable by the bar 136 projecting up from one of the guides 112. The piston rods 134 are spaced from the pivot axis 113 by a distance *2d*. Fluid under the same pressure as that applied to cylinder 130 is applied to cylinders 132 and 133. The operation of the control system of FIG. 9 is as follows:

Assume that the guides are aligned with lane 21, as illustrated, and movement is to be made to lane 20. Fluid pressure is applied to the cylinder 130 to urge the guide to swing toward lane 20. At the same time fluid pressure is relieved in cylinder 132 to permit the guide to move to lane 20. To shift back to lane 21, fluid pressure is applied to cylinder 132. It is resisted by the fluid pressure in cylinder 130. However, the cylinder 132 is operating through a lever arm *2d* which is twice that of the lever arm of the resisting cylinder 130 and hence overcomes the resistance of the cylinder 130. The cylinder 130, however, will stop the guide at lane 21 when the rod 134 has reached the extent of its permissible transverse movement. The shift to lane 22 is effected by reversing the flow of fluid to the cylinder 130. Movement beyond lane 22, however, is blocked by the fluid pressure in cylinder 133 which, due to its lever arm, is sufficient to overcome the force of the piston in cylinder 130. The shift to lane 23 is effected by relieving the pressure in cylinder 133. The reverse operation, that is, the shift from lane 23 to lane 22, is simply the reverse of that described in shifting from lane 20 to lane 21 in that fluid pressure applied to cylinder 133 overcomes the fluid pressure in cylinder 130.

Operation

A set of cases 11 is fed by the case conveyor 12 into the loading section 13 where the cases are stopped in position to receive a pattern of bottles from each lifting head of the set 37 or 38. In the meantime, bottles are fed to the loading station by being first fed single file through a row former 19 and then in multiple lanes (four being illustrated) onto a bottle conveyor section 25. When a full load of bottles, that is, at least two patterns, is detected by the pressure of bottles on pressure switches 29, a cycle of operations for one of the lifting head sets is initiated. The lifting head set, for example 38, descends upon the two patterns of bottles. When the bottles are engaged by the grippers, pneumatic pressure is applied to each lifting head manifold 102 to cause the grippers to grasp the necks of the bottles. The brake bar 31 is applied to the upper surface of the rollers to stop the effective forward thrust of the rollers on the bottles. The pressure switches are also retracted.

If any jam is detected, the micro switch 95 associated with the particular head which encounters the jam will be operated to interrupt the continued operation of that head and the head will be lifted up out of the way. Because the heads are independently vertically-operated, the other operative head can continue to load cases while the jam is cleared, if desired.

The set of heads 38 lifts the two patterns up away from the bottles remaining on the conveyor and over to the center of the transverse mechanism overlying the case conveyor as illustrated in FIG. 4. As soon as the lifting head has cleared the incoming bottles, the brake bar is raised, permitting the conveyor to bring in a fresh supply of bottles to the stops 28.

The case elevator raises two cases in position to receive a deposit of bottles. The lifting heads 38 descend and gently deposit that pattern of bottles into each case. The case elevator lowers and the case conveyor conveys away the filled cases while bringing in an empty set of two cases. The lifting heads 38 rise and the carriage 36 moves transversely to return the lifting heads 38 to a position overlying the bottle conveyor. In its transverse movement, the carriage carries lifting heads 37 which, in the manner described in connection with the lifting heads 38, have grasped two patterns of bottles, over to a position overlying the new set of empty cases. The lifting heads 37 descend into the elevated cases to deposit their patterns of bottles in the cases. Thereafter, the cycle of operations is repeated.

I claim:

1. A case packer comprising, a case conveyor having a loading station, an article conveyor on each side of said case conveyor comprising two laterally spaced endless chains having a plurality of rollers mounted between said chains to support said articles and means for continuously driving said chains, each said article conveyor conveying articles at approximately one-half the speed of the case conveyor, means on each conveyor for stopping a pattern of articles at said loading station, means for detecting a pattern of bottles marshalled at said loading station, an article transfer mechanism overlying said article conveyors at said loading station, said article transfer mechanism comprising, a frame, at least two laterally spaced lifting heads mounted on said frame, each lifting head including a pattern of article grippers, means responsive to said detecting means for moving each said head in lateral and vertical directions to alternately pick up a pattern of articles from said article conveyors and deposit said pattern in a case at said loading station, and means for stopping the movement of articles immediately upstream of said pattern of articles as said pattern of articles is picked up from said article conveyor, said chains being continuously driven while said pattern of articles is picked up, thereby providing a continuous movement of articles toward said loading station.

2. Apparatus according to claim 1 further comprising, a case elevator located at the downstream end of said case conveyor and underlying said transfer mechanism, said case elevator including an elongated tongue adapted to engage the underside of the cases under the transfer mechanism, and means for elevating the tongue to raise the cases to a position to receive a deposit of bottles.

3. Apparatus according to claim 2 in which said means for elevating the tongue is located at the downstream end of said tongue, said tongue being cantilevered from said elevating means in the upstream direction.

4. Apparatus according to claim 3 further comprising, a shock absorber underlying the upstream end of said tongue and engageable by said tongue to dampen vibrations of said tongue when said tongue is lowered.

5. Apparatus according to claim 2 further comprising, friction means mounted alongside said tongue to receive and momentarily retain cases on said tongue.

6. A case packer as in claim 1 in which at least two longitudinally spaced lifting heads are mounted on said frame to cooperate with each article conveyor, said means for stopping movement including means for stopping movement of articles between longitudinally spaced lifting heads.

7. A case packer comprising, a case conveyor having a loading station, an article conveyor on each side of said case conveyor, said conveyor having means dividing articles from a single file section into a section having a plurality of files of articles, means on each conveyor for stopping a pattern of articles at said loading station, each pattern consisting of said plurality of files and a predetermined multiple of rows of articles.

an article transfer mechanism overlying said article conveyors at said loading station, said article transfer mechanism comprising, a frame, at least two laterally spaced lifting heads mounted on said frame, each lifting head including a pattern of article grippers, means for moving each said head in lateral and vertical directions to alternately pick up a pattern of articles from said article conveyor and deposit said pattern in a case at said loading station, electric eye means downstream of said article dividing means operable to detect a backup of articles feeding into said transfer mechanism, and means for stopping the feed of articles through said dividing means upon detection of said backup.

8. A case packer comprising, a case conveyor having a loading station, means for bringing at least two cases, in longitudinally spaced relation into said loading station, an article conveyor on each side of said case conveyor, each said article conveyor conveying articles at approximately one-half the speed of the case conveyor, means on each conveyor for stopping at least two longitudinally spaced patterns of articles at said loading station, an article transfer mechanism overlying said article conveyors at said loading station.

said article transfer mechanism comprising, a frame straddling said article conveyors, at least a pair of longitudinally spaced lifting heads mounted on each side of said frame, each lifting head including a pattern of article grippers, said pairs of lifting heads being laterally spaced apart by the distance between centers of said case conveyor and an article conveyor, means for moving each said pair of heads in lateral and vertical directions to alternately pick up patterns of articles from said article conveyor and deposit said patterns in said cases at said loading station, one pair of heads gripping two patterns of articles while the other pair of heads deposits two patterns of articles in two cases.

9. A case packer as in claim 8 further comprising, means for shifting the heads of each pair longitudinally with respect to each other to accommodate variations between the spacing of article patterns and the spacing of cases.

10. A case packer comprising, a case conveyor having a loading station, an article conveyor on each side of said case conveyor, means on each conveyor for stopping a pattern of articles at said loading station, an article transfer mechanism overlying said article conveyors at said loading station, said article transfer mechanism comprising, a frame, a carriage supported on said frame over said conveyors and means for transversely reciprocating said carriage, at least two laterally spaced lifting heads mounted on said carriage in laterally fixed relation to each other, each lifting head including a pattern of article grippers, means for moving each said head independently of the other in vertical directions whereby to alternately pick up a pattern of articles from said article conveyor, to shift by means of said carriage to said loading station and to deposit said pattern in a case at said loading station, a jam detector on each head operative to detect an improper pattern of articles and to cause said head to be maintained in a vertical inoperative position with respect to said carriage, means permitting said remaining head to continue to load cases while said first mentioned head is in inoperative position.

11. A case packer as in claim 10 further comprising, a pair of spaced transverse rods mounted on said frame over said conveyors, said carriage being supported on said rods, at least two pistons and cylinders mounted vertically on said carriage and each connected to a respective lifting head to form said independent moving means, and control means responsive to detecting a pattern of articles present at a respective loading station to cause said piston and cylinder to lower its respective head into gripping engagement with a pattern of articles.

12. A case packer comprising:

a case conveyor having a loading station, an article conveyor on each side of said case conveyor, said conveyor having means dividing articles from a single file section into a section having a plurality of files of articles, said dividing means comprising, a guide pivoted at its upstream end and having a downstream end swingable to a plurality of laterally spaced positions, a wheel rotatably mounted on a vertical axis at the downstream end of said guide, pins spaced around the periphery of said wheel and projectable into the path of articles passing through said guide, and means for braking said wheel, means on each conveyor for stopping a pattern of articles at said loading station, each pattern consisting of said plurality of files and a predetermined multiple of rows of articles, an article transfer mechanism overlying said article conveyors at said loading station, said article transfer mechanism comprising, a frame, at least two laterally spaced lifting heads mounted on said frame, each lifting head including a pattern of article grippers, means for moving each said head in lateral and vertical directions to alternately pick up a pattern of articles from said article conveyor and deposit said pattern in a case at said loading station.

13. A case packer for irregularly shaped articles comprising, a case conveyor having a loading station, an article conveyor on each side of said case conveyor, said article conveyor comprising a plurality of rollers rotatably mounted on spaced endless chains, and means for continuously driving said chains, a brake above said article conveyor adjacent said loading station for engaging the upper surface of said rollers to stop a pattern of articles at said loading station while providing a constant influx of articles upstream of said loading station, an article transfer mechanism overlying said article conveyors at said loading station, said article transfer mechanism comprising, a frame, at least two laterally spaced lifting heads mounted on said frame, each lifting head including a pattern of article grippers, means for moving each said head in lateral and vertical directions to alternately pick up a pattern of articles from said article conveyor and deposit said pattern in a case at said loading station.

14. A case packer comprising, a case conveyor having a loading station, an article conveyor on each side of said case conveyor, said conveyor having means dividing articles from a single file section into a section having a plurality of files of articles, said conveyor including, downstream from said dividing means, a conveyor section comprising a plurality of rollers mounted on laterally spaced endless chains and means for continuously driving said chains, means on each conveyor including a brake engageable with the upper surface of said rollers for stopping a pattern of articles at said loading station, each pattern consisting of said plurality of files and a predetermined multiple of rows of articles, said brake stopping said articles at said loading station while said conveyor section continues to provide an influx of articles upstream of said loading station, an article transfer mechanism overlying said article conveyors at said loading station, said article transfer mechanism comprising, a frame, at least two laterally spaced lifting heads mounted on said frame, each lifting head including a pattern of article grippers, means for moving each said head in lateral and vertical directions to alternately pick up a pattern of articles from said article conveyor and deposit said pattern in a case at said loading station.

15. A case packer comprising, a case conveyor having a loading station, said case conveyor including two laterally spaced endless chains having case engaging lugs, an article conveyor on each side of said case conveyor, means on each conveyor for stopping a pattern of articles at said loading station, said article transfer mechanism comprising, a frame, at least two laterally spaced lifting heads mounted on said frame, each lifting head including a pattern of article grippers, means for moving each said head in lateral and vertical directions to alternately pick up a pattern of articles from said article conveyor and deposit said pattern in a case at said loading station, a case elevator located at the downstream end of said case conveyor and underlying said transfer mechanism, said case elevator including an elongated tongue located between said chains and adapted to engage the underside of the cases under the transfer mechanism, means for elevating the tongue to raise the cases to a position to receive a deposit of articles, and friction means mounted on said tongue outboard of and above said chains to receive and momentarily retain cases on said tongue as the cases are elevated.

* * * * *